US006422112B2

(12) United States Patent
Gottschalk et al.

(10) Patent No.: US 6,422,112 B2
(45) **Date of Patent: *Jul. 23, 2002**

(54) MACHINE FOR CUTTING STACKED SHEETS OF STOCK

(75) Inventors: Gerd Gottschalk, Kelkheim-Fischbach; Horst Schneider, Hofheim/Taunus, both of (DE)

(73) Assignee: Adolf Mohr Maschinenfabrik GmbH & Co. KG, Hofheim (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/438,038

(22) Filed: Nov. 10, 1999

(30) Foreign Application Priority Data

Nov. 12, 1998 (DE) ..... 198 52 170

(51) Int. Cl.[7] ..... B26D 5/00

(52) U.S. Cl. ..... 83/74; 83/76.8; 83/209; 83/365

(58) Field of Search ..... 356/372, 353, 356/359; 348/61; 382/111; 83/74, 75, 76.8, 209, 367, 365, 361

(56) References Cited

U.S. PATENT DOCUMENTS 3,238,824 A * 3/1966 Jallo ..... 83/23
4,139,035 A * 2/1979 Bystedt et al. ..... 144/312
4,483,615 A * 11/1984 Bieringer et al. ..... 356/237
4,850,257 A * 7/1989 Mohr ..... 83/93
4,879,659 A * 11/1989 Bowlin et al. ..... 364/468
4,895,059 A * 1/1990 Peterson et al. ..... 83/468.7
5,121,438 A * 6/1992 Kawauchi et al. ..... 382/8
5,127,294 A * 7/1992 Mohr ..... 83/412
5,131,301 A * 7/1992 Gergek ..... 83/365
5,251,141 A * 10/1993 Payr ..... 83/367
5,267,168 A * 11/1993 Antonissen et al. ..... 364/468
5,497,685 A * 3/1996 Mohr ..... 83/282
5,537,946 A * 7/1996 Sadeh et al. ..... 112/475.03
5,586,479 A * 12/1996 Roy et al. ..... 83/74
5,790,687 A * 8/1998 McLaughlin et al. ..... 382/111
5,806,398 A * 9/1998 Emerson et al. ..... 83/522.21
5,960,104 A * 9/1999 Conners et al. ..... 382/141

* cited by examiner

*Primary Examiner*—M. Rachuba
*Assistant Examiner*—Kim Ngoc Tran
(74) *Attorney, Agent, or Firm*—Max Fogiel

(57) ABSTRACT

A machine for cutting stacked sheets of stock. The machine has a counter for accommodating the stock. The rear of the counter accommodates the stock to be cut and the front of the counter the cut stock. The rear of the counter also accommodates a mechanism for advancing the stack and a baffle for one side of the stack to rest against. A bent is positioned above the counter and accommodates a blade for cutting the stock and a holdfast that can be lowered onto the top of the stack. A control panel and a display panel are positioned on the front side. The machine in accordance with the present invention is characterized by at least one camera (22) at the rear (9) of the counter. The camera monitors the position of the stock in relation to the stack-advancing mechanism (10) or the lateral baffle (12) and displays on the display panel (17) a real-time image (26) of what it can discern. The operator can accordingly indirectly but precisely monitor the position of the stock in relation to the stack-advancing device or to the lateral baffle or both but only when that position needs correcting.

17 Claims, 5 Drawing Sheets

FIG.2
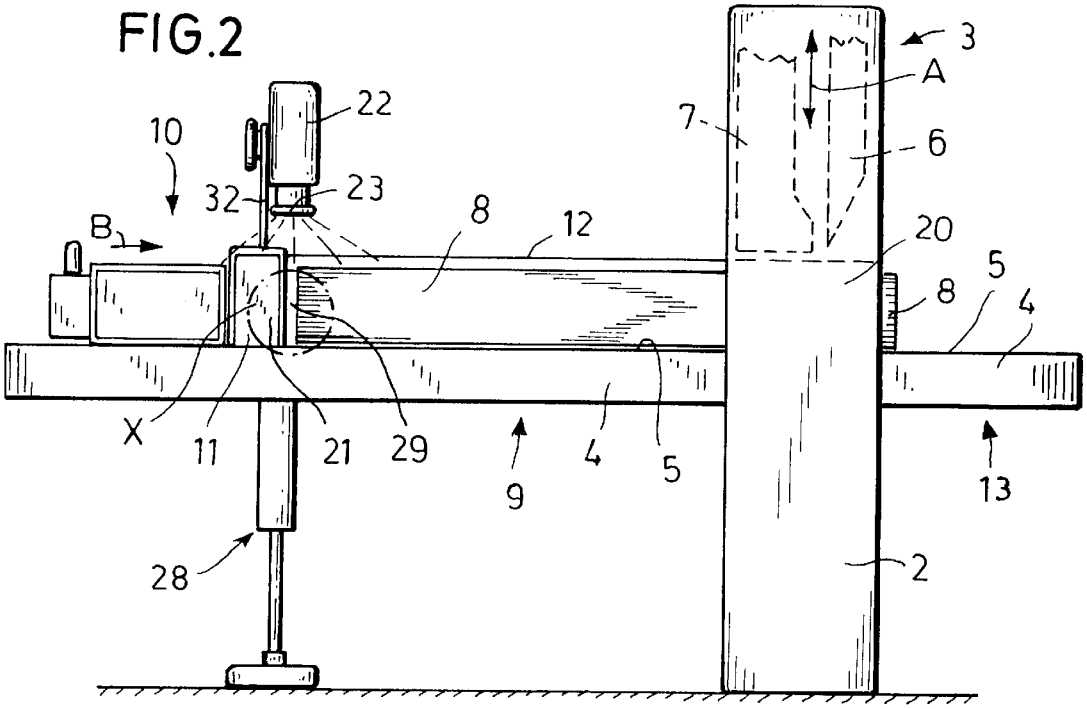
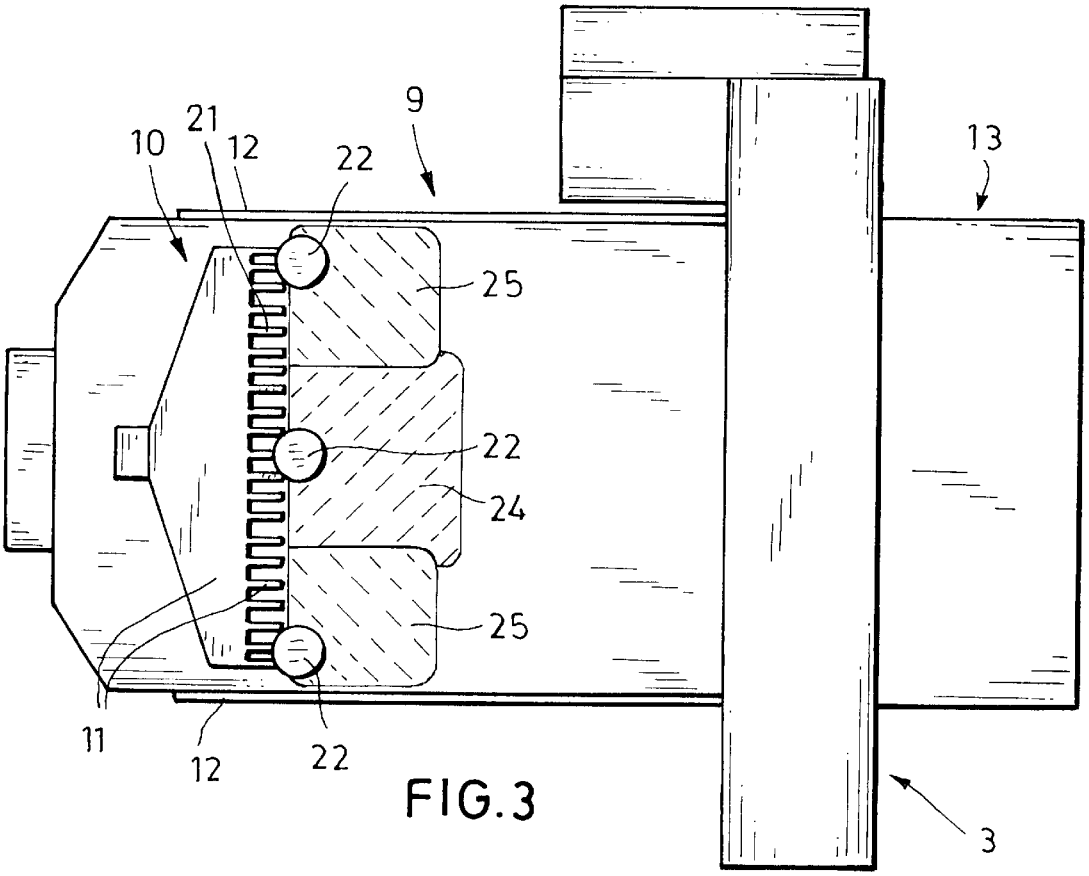
FIG.3

MACHINE FOR CUTTING STACKED SHEETS OF STOCK

BACKGROUND OF THE INVENTION

The present invention concerns a machine for cutting stacked sheets of stock. The machine has a counter for accommodating the stock. The rear of the counter accommodates the stock to be cut and the front of the counter the cut stock. The rear of the counter also accommodates a mechanism for advancing the stack and a baffle for one side of the stack to rest against. A bent is positioned above the counter and accommodates a blade for cutting the stock and a holdfast that can be lowered onto the top of the stack. A control panel and a display panel are positioned on the front side.

A machine of the aforesaid genus is known from Europe Patent 0 056 974 A1 and German 19 637 027 A1. Such machines are employed to cut stacked sheets of in particular paper, cardboard, plastic, and similar stock. When in particular the sheets are to be assembled, the stack-advancing saddle must move into position in relation to the blade very precisely to ensure that the blade can cut the stack very precisely in relation to the specified line of separation. Even slight errors, deviations due to warping of the sheets for example, can deflect the blade from the intended line of separation. In assemblages in particular the incision can enter beyond the edges of the intended format. To prevent such malfunctions, the assembled sheets are held down fast such that the edges of the intended format are not directly adjacent but separated. This procedure of course necessarily leaves strips between the cut edges. Similarly, the edge contours of the stacks are trimmed before the stacks are cut. Once the edges have been cut, the stack being cut will be present in a well defined form or dimension, which decisively affects the precision of the subsequent main cutting processes.

In practice, it is very difficult for the operator to monitor the precise position of the stock being cut at the rear of the cutting surface. As the front of the counter empties, the operator must lean far over it to force the stack or stacks being cut against the stack-advancing mechanism or under the blade and aligns it or them against the abutment lateral baffle. The operator will often unnecessarily be compelled to repeat aligning operations due to his inability to see the rear of the counter and accordingly whether the stock has already been satisfactorily aligned or not.

The operator must be able to monitor various procedures at the rear of the stock-accommodating counter. When assembly sheets are being cut for example, the upper sheets in adjacent stacks can override the stack-advancing mechanism. Stacks can become displaced. Individual sheets can become displaced, by compressed air distorting the uppermost sheet for example. When in particular the sheets are not provided with cutting marks, it is almost impossible for the operator to monitor the rear of the counter because the individual sheets run into each other without visible reference marks.

SUMMARY OF THE INVENTION

The object of the present invention is accordingly an improved machine of the aforesaid genus that will allow the operator to precisely determine the position of the stock being cut, so that corrections will need to be made only when the stock is not resting precisely against the stack-advancing mechanism or abutment lateral baffle.

This object is attained in accordance with the present invention in a machine of the aforesaid genus by at least one camera at the rear of the stock-accommodating counter that monitors the position of the stock being cut in relation to the stack-advancing mechanism or lateral baffle, the image being displayed on the display in real time.

The machine in accordance with the present invention considerably improves not only operator ergonomics but also the quality of the cut. The operator will be able to easily carry out all requisite operations, mad corrections in the position of the stack will need to be made when errors at the rear of the stock-accommodating counter are displayed to the operator in real time. Only in this event will the operator need to intervene below the bent for example and correct the lateral position of the stack or stacks with a square or to align the stack or stacks with the square against the stack-advancing mechanism from the front. The indirect monitoring of the rear of the stock-accommodating counter with the camera, showing the real-time image on the display, will eliminate unnecessary interventions during the cutting process, considerably improving the accuracy of the cut and accelerating the process. Operator ergonomics will be essentially improved.

It is of advantage for the real-time image obtained by the camera at the rear of the stock-accommodating counter to be displayed only while the stack is being aligned in relation to the stack-advancing mechanism or lateral baffle. This approach will be of assistance to the operator in that the display of the real-time image will serve as a clue to monitor the position of the stack at the rear of the counter and intervene to correct it only when it needs to be corrected. The operator will be assisted even more if the image is displayed only when the stack is incorrectly positioned in relation to the stack-advancing mechanism or lateral baffle. The operator can then concentrate entirely on cutting the stock and on operating the machinery, the display indicating that the alignment is incorrect and that the position of the stack needs to be adjusted in relation to the stack-advancing mechanism or lateral baffle. One particular feature of the machine in accordance with the present invention is that it is impossible to initiate a cut with the blade while the stack is incorrectly positioned in relation to the stack-advancing mechanism or lateral baffle. The operator will accordingly be able to make a cut with the machine only when the stack is correctly positioned in relation to the stack-advancing mechanism or lateral baffle. This feature contributes considerably to the quality of the finished product.

It is basically possible to provide a separate screen to display the real-time image. Still, the display in one preferred embodiment displays graphical symbols representing various machine and operation routines, and the image can be superimposed onto it. The symbols can be partly or entirely replaced by the real-time image in this event. If the image replaces only some of the symbols, the rest of the display can simultaneously display the most important routines.

The operator will accordingly in accordance with the present invention be able to view a real-time image of the situation at the rear of the stack-supporting surface, and in a vicinity of the display panel that is particularly easy for him to see, facilitating corrections and allowing him to monitor the precise alignment of the stack in relation to the stack-advancing mechanism and lateral baffle.

The method of monitoring the rear of the stock-accommodating counter can be engineered in many different ways. Preferably, however, there will be several monitoring cameras distributed over the width of the counter.

It will be of advantage for the areas monitored by the monitoring cameras to overlap, each individual camera monitoring one strip of the rear of the stock-accommodating counter extending in relation to the direction the stacks are advanced in. The images can be displayed separately or composite. Each camera can for example be mounted on the stack-advancing mechanism and travel in relation to with it. Such an approach is of particular advantage when the precise alignment of the stack must be monitored against in relation to the stack-advancing mechanism. Mounting a particular camera stationary in relation to the rear of the stock-accommodating counter is also conceivable, in which case it will monitor a specific area of the counter. This approach can be a particular advantage when it is the position of the stack in relation to the lateral baffle that is being monitored. The camera or cameras can monitor the rear of the stock-accommodating counter from above or from the side or both. It is also conceivable to position the camera or cameras such that they can travel back and forth in relation to the rear of the stock-accommodating counter. This approach will make it possible to monitor the position of the stack in relation to both the stack-advancing mechanism and the lateral baffle with only one camera.

The monitoring camera or cameras in one particular embodiment of the present invention can monitor the stack between the stack-advancing mechanism and a lateral baffle from behind. The camera's or cameras' mount will in this event extend substantially horizontally. This approach will allow reliable monitoring even when the uppermost sheet in the stack rests correctly against, the stack-advancing mechanism and the lateral baffle although the other sheets in the stack do not. The camera can in this event be able to cover the rear of the stack as well, covering the rear of the stock-accommodating counter through the gap between the stack advancing mechanism and the baffle.

A particularly sensible feature of the present invention is that the monitoring camera or cameras can pivot. Such a camera can for example pivot out of a vertical axis of observation wherein it can monitor a stack from above, and into a horizontal axis of observation, wherein it can monitor the rear of the stack from behind. This feature is particularly easy to incorporate by mounting the camera in an upright that can be pivoted by a motor, especially 90°.

Due to the optionally variable distance between the monitoring camera and the object being monitored, the particular area of interest of the stock being cut, that is, the camera should be provided with a variable-focus lens. A zoom lens will allow the operator to display the monitored area in the form of a magnified or reduced real-time image.

The aforesaid display of the real-time image only in the event of incorrect alignment of the stack in relation to the stack-advancing mechanism or lateral baffle is attained in accordance with a preferred advanced embodiment of the present invention in that the monitoring camera is connected to an image processor that can detect the position of the stock in relation to the stack-advancing mechanism or lateral baffle. Such image processors are state-of-the-art and allow very precise edge discrimination. When an edge of the stack does not coincide with its prescribed position against the stack advancing mechanism or lateral baffle, the image processor will detect the error and forward the information to the machine's display system for display in relation to with the real-time image. Once the situation has been corrected and the stock being. cut rests precisely against the stack advancing mechanism or lateral baffle, the processor will detect the correction and eliminate the real-time image from the display. Further-characteristics of the present invention will now be specified with respect to the accompanying drawing, all specific characteristics and combinations thereof being essential to the invention.

BRIEF DESCRIPTION OF THE DRAWINGS

The drawing represents various embodiments of the present invention by way of example without restricting its scope in any way.

FIG. 3 is a schematic top view of the machine.

DESCRIPTION OF THE PREFERRED EMBODIMENTS

Figure 1:
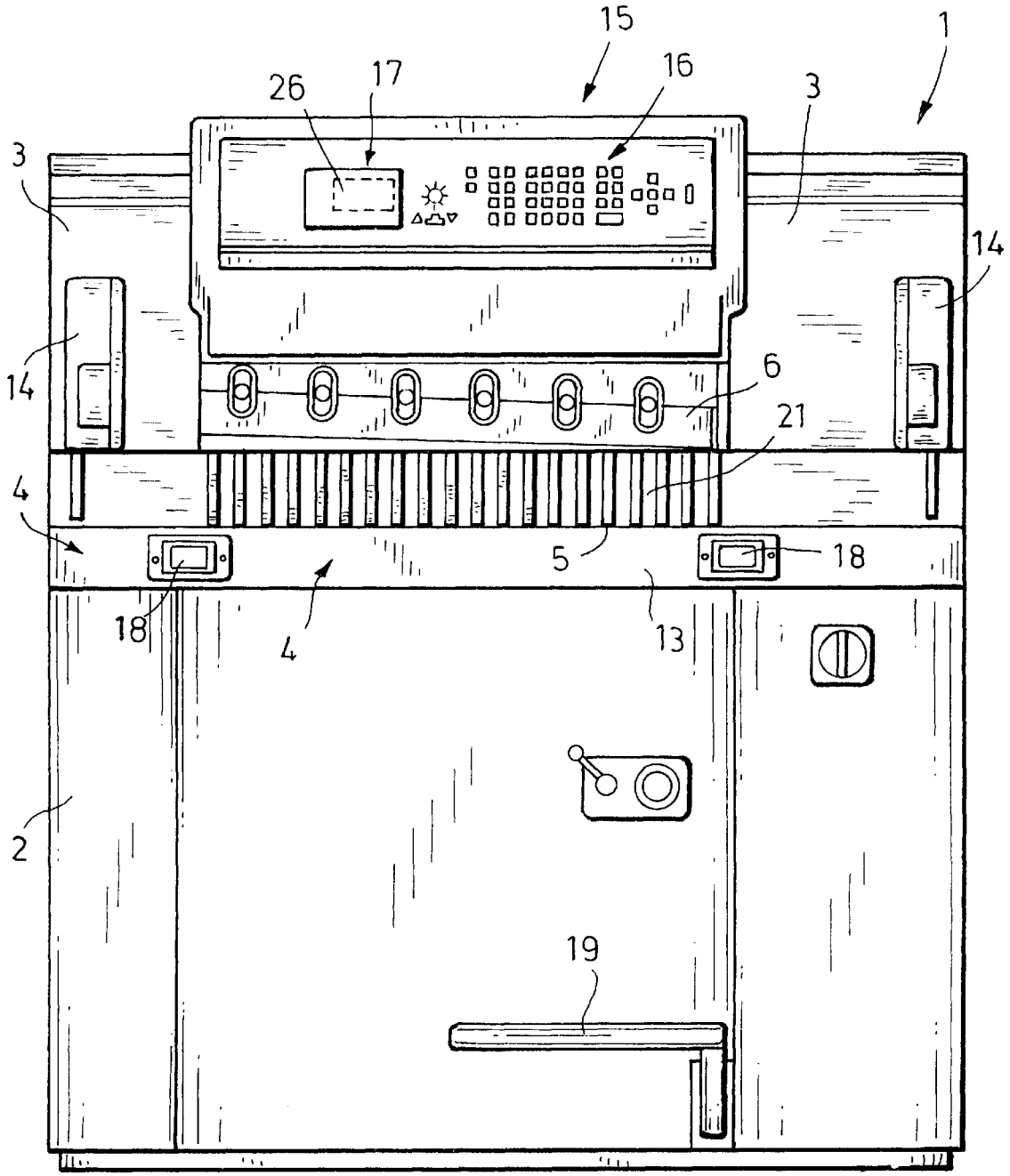
FIG. 1 is a side view of a stock-cutting machine in accordance with the present invention from the operator's point of view, FIG. 2 a schematic side view of the stock-cutting machine.

A machine 1 is employed to cut stacked sheets of such stock 8 as paper, cardboard, plastic, etc in particular. Machine 1 includes a frame 2 with a bent 3 at the top, a stock-accommodating counter 4 that rests on supports 28 at the rear, and the upper, stock-supporting, surface 5 of counter 4, extending perpendicular to the plane of projection. Traveling up and down in bent 3 are a blade 6 and, behind it, a holdfast 7. Blade 6 and holdfast 7 can be raised and lowered in the direction indicated by arrow A by unillustrated mechanisms. Accommodated at the rear 9 of stock-accommodating counter 4 is a stack-advancing mechanism 10. Stack-advancing mechanism 10 has a conventional saddle 11 with a rake 21 on the front that advances the stock 8 being cut in the direction indicated by arrow B. The side of saddle 11 facing the operator parallels the cutting plane of blade 6. The saddle travels back and forth in relation to the rear 9 of stock-accommodating counter 4. At each end of rear 9 and extending essentially in relation to its length is a lateral baffle 12, against one or the other of which stock 8 is to be aligned.

On each side of the front 13, facing the operator, of stock-accommodating counter 4 is a light barrier 14. Light barriers 14 prevent improper entry into the vicinity of blade 6. Above blade 6 and on the side of bent 3 facing the operator is a control panel 15 with input and control keys 16 and a display panel 17. On the front of counter 4 are two stock-cut-initiating buttons 18. On the base of stock-cutting machine 1 is a pedal 19 for indicating a cut.

FIG. 1 shows the rake 21 on the front of saddle 11, visible through the opening 20 between the raised blade 6 and stock-supporting surface 5, against which rake the stock is aligned for cutting. Only through opening 20 can the operator see the rear 9 of counter 4 when monitoring the position of stock 8 in relation to saddle 11 and to the particular lateral baffle 12 involved.

FIGS. 2 and 3 illustrate three monitoring cameras 22 mounted on webs 32 on saddle 11. Cameras 22 are position above the saddle with their lenses 23 facing down and pointed toward rake 21 and the area in front of it. One camera 22 is position half-way in relation to the width of the rear 9 of stock-accommodating counter 4 and monitors a middle monitoring area 24 in front of saddle 11. The other cameras are positioned at each side of rear 9 and cover monitoring areas 25 that include lateral baffles 12 in front of the saddle.

Figure 4:
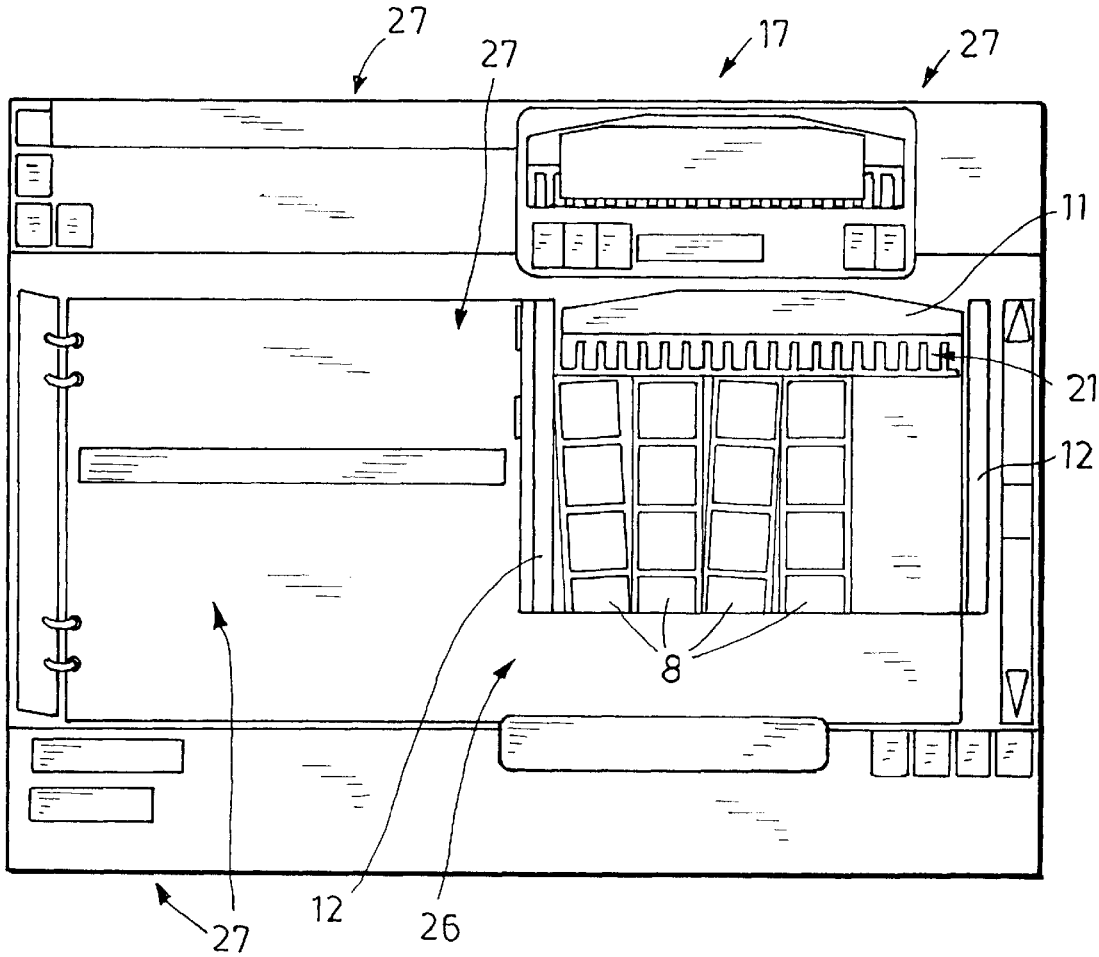
FIG. 4 is a larger-scale view of the machine's display.

FIG. 4 illustrates the display panel 17 that faces the operator and displays the real-time image 26 captured by cameras 22 and replacing some of the screen's symbols, which ordinarily represent operating and status functions relevant to the stock-cutting process or program. Symbols of only secondary significance while the stock is being aligned on the rear 9 of stock-accommodating counter 4 are not displayed at that stage.

The components of the real-time image 26 are displayed schematically and include stock-advancing saddle 11 with its rake 21, both lateral baffles 12, and four stacks of stock 8 aligned in relation to the direction of advance. Image 26 informs the operator in this case that all four stacks have not yet been correctly aligned in relation to left-side lateral baffle 12 and saddle 11. The situation is illustrated in circle X in FIG. 5 and represented by the gap 29 between rake 21 and stock 8 in FIG. 2. The operator will accordingly realize that he must force the four stacks against left-side lateral baffle 12 and against saddle 11 with the square. Real-time image 26 will directly inform him when he has achieved the correct alignment of stock 8 in relation to baffle 12 and saddle 11. He can then immediately initiate the stock-cutting process by pressing both stock-cutting initiating buttons 18, upon which real-time image 26 will be erased and the stock can be cut by depressing pedal 19. When further alignment is necessary, image 26 will be displayed again.

The transmission of the image picked up by cameras 22 to display panel 17 occurs by way of conventional state-of-the-art equipment. The depth of focus of the lenses employed in monitoring cameras 22 can be varied when desired by the procedures conventional for cameras with variable focal lengths.

Figure 5:
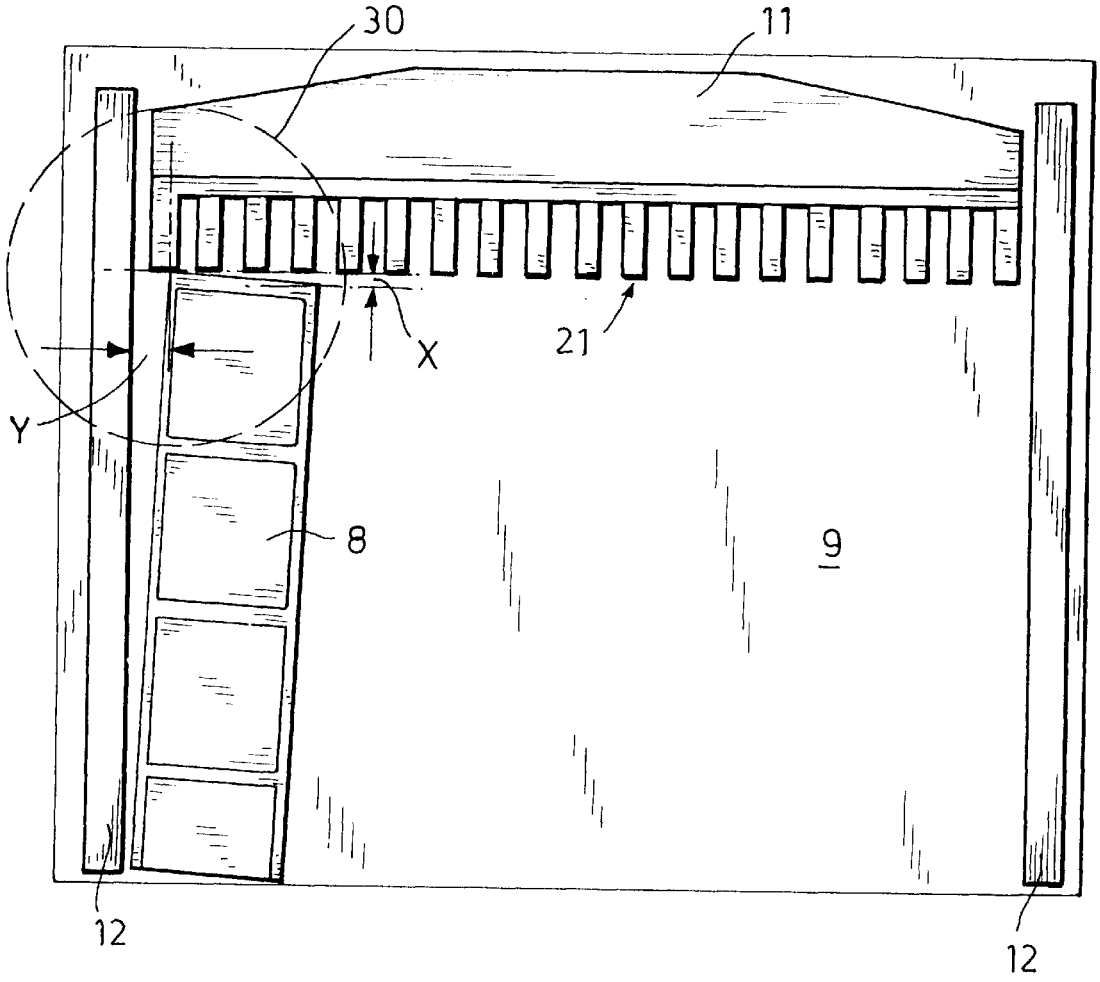
FIG. 5 is a top view of the rear of the stock-accommodating counter with a detail representing an incorrect alignment of the stock in relation to the stack-advancing mechanism and a lateral baffle.

FIG. 5 is a top view of the rear 9 of stock-accommodating counter 4 showing the two lateral baffles 12 and stock-advancing saddle 11. The rear of stock 8 is a considerable distance Y away from left-side baffle 12 while the front of the stock is near it. The stock is accordingly at an angle to the baffles. The rear end of stock 8 rests against saddle 11 in the vicinity of left-side baffle 12, and the area facing away from the saddle is accordingly at a longer distance X from it. A movable monitoring camera 12 is positioned at the angle between saddle 11 and left-side baffle 12 and connected to an unillustrated image processor. The field discerned by camera 22 is represented by circle 30 in FIG. 5. The processor outputs the position of stock 8 in relation to stack-advancing mechanism 10 and lateral baffle 12. A camera and image processor of this type are produced under the designation Nais Micro-Imagechecker M100/M200 by Matsushita Electric Works Ltd. This system is provided with an edge-finding function and allows flexible edge recognition. It can also identify deviations and determine the orientation of an object. The monitoring camera and image processor are configured in accordance with the present invention to display a real-time image 26 only when stock 8 is incorrectly aligned in relation to stack-advancing mechanism 10 and lateral baffle 12.

Figure 6:
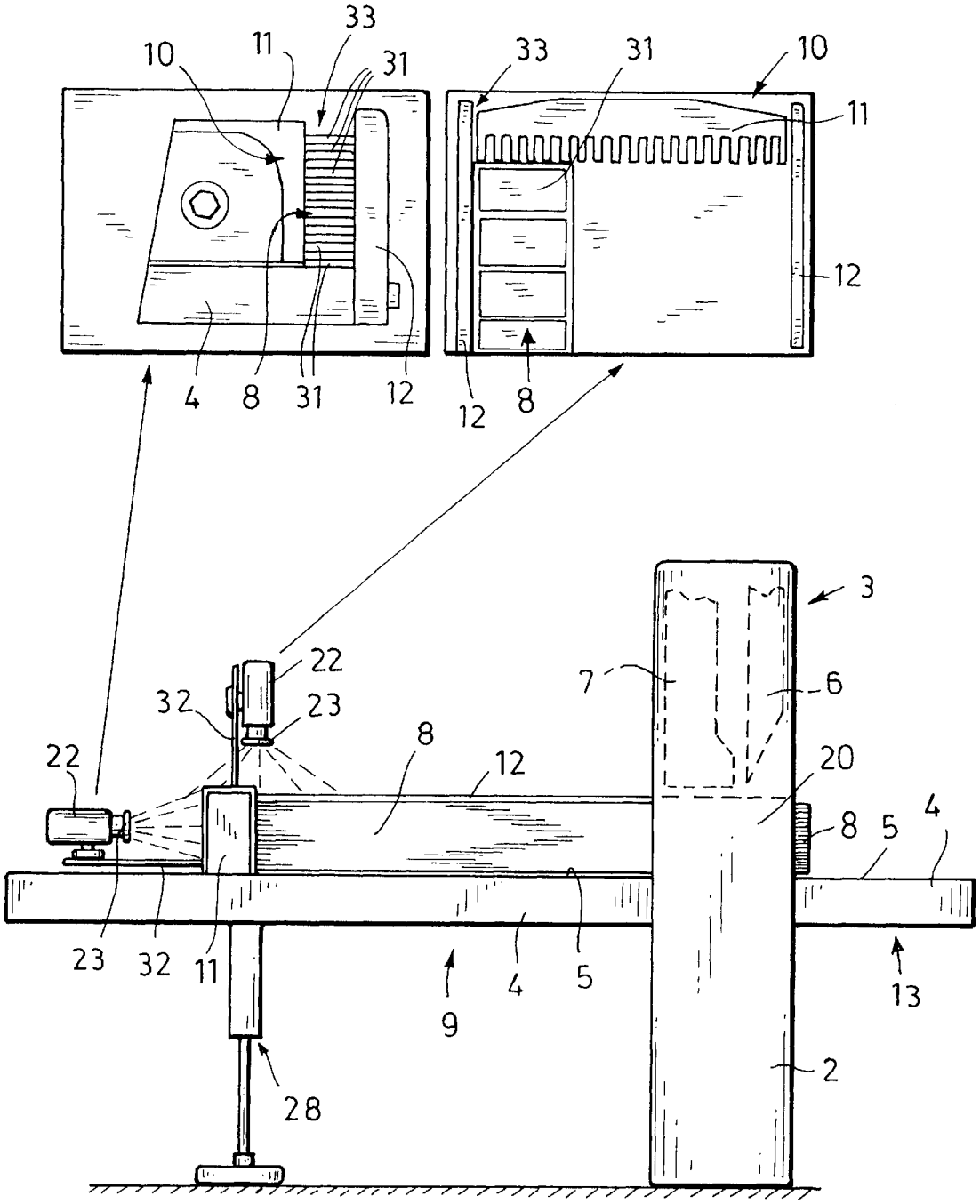
FIG. 6 is a schematic side view of the stock-cutting machine similar to that in FIG. 2 but including a monitoring camera that functions in relation to both a vertical and a horizontal axis in relation to with the images associated with each position.

FIG. 6 is a view similar to that in FIG. 2 and illustrates two cameras 22 monitoring the mechanism that advances the stacks of stock 8 the right side of the rear 9 of stock-accommodating counter 4. Additional cameras can of course also be provided to monitor the midsection and left side of rear 9 as illustrated in FIG. 3. FIG. 6 shows one camera 22 mounted above 11 as illustrated in FIG. 2 with its lens 23 pointed down and covering the right-hand sections and an area in front thereof. Another camera 22, also mounted on the stack-advancing mechanism, is positioned behind saddle 11 between it and the camera on the right. This camera's lens 23 is positioned horizontal and covers the gap 33 between saddle 11 and the baffle and accordingly monitors the precise the state of the individual sheets 31 of stock 8 in the stack. From the display of the area covered by the vertically oriented camera 22 illustrated at the top right of FIG. 6 it will be evident that the upper sheet 31 of stock 8 is resting precisely against saddle 11 and right hand lateral baffle 12. From the display of the area covered by the horizontally oriented camera 22 at the top left of the figure it will be evident that, although both upper sheets 31 are resting precisely against right-hand baffle 12, some of the lower sheets in the stack are not. In this event in accordance with one practical application of the present invention, only the image indicating incorrect alignment, the image at the upper left, will appear on the screen, allowing him to make the necessary corrections. Only once the stock 8 is precisely aligned over its total height in relation to both lateral baffle 12 and saddle 11 will the operator be able to press a stock-cut-initiating button 18. The machine can accordingly only cut a stack of material once the stock has been precisely aligned. Incorrectly aligned cuts will be impossible. One pivoting camera can be employed instead of two to monitor the relevant area of the saddle, in which event the camera will be connected by way of a single web 32 to an unillustrated motor accommodated in saddle 11.

What is claimed is:

1. A machine for cutting stacked sheets of stock, comprising: a counter with a rear side for receiving the stock to be cut; said counter having a front side for receiving stock that has been cut; means for advancing a stack of sheets of stock and an abutment for resting one side of the stack against said abutment; a bent positioned above said counter and receiving a blade for cutting the stock; a holdfast lowerable onto a top side of the stack; a control panel and a display panel positioned on said front side; at least one monitoring camera on said rear side of said counter for monitoring positions of said stock in relation to said stack advancing means and displaying on said display panel a real-time image discernable by said camera for correcting positions of said stock due to imprecise location of said stock against said stack advancing means or said abutment; a screen on said display panel for displaying the real-time image picked up by said monitoring camera; said real-time image replacing at least some graphical symbols on said screen; said real-time image being displayed only while the stock is being aligned in relation to said stack-advancing means or said abutment; said blade being prevented from cutting the stock when aligned incorrectly in relation to said stack-advancing means or said abutment; a plurality of cameras distributed over a width of said rear side of said counter; at least one camera monitoring said rear side of said counter from a specific location; said stack-advancing means being spaced from said abutment by a gap, said at least one camera monitoring said rear side of said counter through said gap; means for moving said at least one monitoring camera back and forth in relation to said rear side of said counter; said at least one monitoring camera being mounted on said stack-advancing means and traveling along with said stack-advancing means; said at least one monitoring camera having a top image pickup position and a bottom image pickup position, said at least one camera pivoting between said top image pickup position and said bottom image pickup position; a lens with a variable focal length in said at least one monitoring camera; image processor means connected to said at least one monitoring camera and calculating the stock position in relation to said stack-advancing means or to said abutment.

2. A machine for cutting stacked sheets of stock, comprising: a counter with a rear side for receiving the stock to be cut; said counter having a front side for receiving stock that has been cut; means for advancing a stack of sheets of stock and an abutment for resting one side of the stack against said abutment; a bent positioned above said counter and receiving a blade for cutting the stock; a holdfast lowerable onto a top side of the stack; a control panel and a display panel positioned on said front side; at least one monitoring camera on said rear side of said counter for monitoring positions of said stock in relation to said stack advancing means and displaying on said display panel a real-time image discernable by said camera for correcting positions of said stock due to imprecise location of all stacked sheets of said stock against said stack advancing means or said abutment at said rear side of said counter, said positions of said stock being corrected so that a sheet at the top of the stack and every sheet in the stack beneath the top sheet is precisely located against said stack advancing means or said abutment at said rear side of said counter.

3. A machine as defined in claim 2, including a screen on said display panel for displaying the real-time image picked up by said monitoring camera.

4. A machine as defined in claim 2, wherein said real-time image is displayed only while the stock is being aligned in relation to said stack-advancing means or said abutment.

5. A machine as defined in claim 2, wherein said real-time image is displayed only while the stock is being aligned in relation to said stack-advancing means and said abutment.

6. A machine as defined in claim 2, wherein said real-time image is displayed only when the stock is incorrectly aligned in relation to said stack-advancing means or said abutment.

7. A machine as defined in claim 6, wherein said blade is prevented from cutting the stock when aligned incorrectly in relation to said stack-advancing means or said abutment.

8. A machine as defined in claim 2, including a plurality of cameras distributed over a width of said rear side of said counter.

9. A machine as defined in claim 2, wherein said at least one camera monitors said rear side of said counter from a specific location.

10. A machine as defined in claim 2, including image processor means connected to said at least one monitoring camera and calculating the stock position in relation to said stack-advancing means or to said abutment.

11. A machine for cutting stacked sheets of stock, comprising: a counter with a rear side for receiving the stock to be cut; said counter having a front side for receiving stock that has been cut; means for advancing a stack of sheets of stock and an abutment for resting one side of the stack against said abutment; a bent positioned above said counter and receiving a blade for cutting the stock; a holdfast lowerable onto a top side of the stack; a control panel and a display panel positioned on said front side; at least one monitoring camera on said rear side of said counter for monitoring positions of said stock in relation to said stack advancing means and displaying on said display panel a real-time image discernable by said camera for correcting positions of said stock due to imprecise location of all stacked sheets of said stock against said stack advancing means or said abutment at said rear side of said counter; and means for moving said at least one monitoring camera back and forth in relation to said rear side of said counter; said positions of said stock being corrected so that a sheet at the top of the stack and every sheet in the stack beneath the top sheet is precisely located against said stack advancing means or said abutment at said rear side of said counter.

12. A machine as defined in claim 11, wherein at least some graphical symbols on said screen describe functions of parts of the machine.

13. A machine as defined in claim 11, wherein said at least one monitoring camera has a top image pickup position and a bottom image pickup position, said at least one camera pivoting between said top image pickup position and said bottom image pickup position.

14. A machine for cutting stacked sheets of stock, comprising: a counter with a rear side for receiving the stock to be cut; said counter having a front side for receiving stock that has been cut; means for advancing a stack of sheets of stock and an abutment for resting one side of the stack against said abutment; a bent positioned above said counter and receiving a blade for cutting the stock; a holdfast lowerable onto a top side of the stack; a control panel and a display panel positioned on said front side; at least one monitoring camera on said rear side of said counter for monitoring positions of said stock in relation to said stack advancing means and displaying on said display panel a real-time image discernable by said camera for correcting positions of said stock due to imprecise location of all stacked sheets of said stock against said stack advancing means or said abutment at said rear side of said counter; a lens with a variable focal length in said at least one monitoring camera, said positions of said stock being corrected so that a sheet at the top of the stack and every sheet in the stack beneath the top sheet is precisely located against said stack advancing means or said abutment at said rear side of said counter.

15. A machine for cutting stacked sheets of stock, comprising: a counter with a rear side for receiving the stock to be cut; said counter having a front side for receiving stock that has been cut; means for advancing a stack of sheets of stock and an abutment for resting one side of the stack against said abutment; a bent positioned above said counter and receiving a blade for cutting the stock; a holdfast lowerable onto a top side of the stack; a control panel and a display panel positioned on said front side; at least one monitoring camera on said rear side of said counter for monitoring positions of said stock in relation to said stack advancing means and displaying on said display panel a real-time image discernable by said camera for correcting positions of said stock due to imprecise location of all stacked sheets of said stock against said stack advancing means or said abutment at said rear side of said counter; said real-time image being displayed only while the stock is being aligned in relation to said stack-advancing means or said abutment, said positions of said stock being corrected so that a sheet at the top of the stack and every sheet in the stack beneath the top sheet is precisely located against said stack advancing means or said abutment at said rear side of said counter.

16. A machine for cutting stacked sheets of stock, comprising: a counter with a rear side for receiving the stock to be cut; said counter having a front side for receiving stock that has been cut; means for advancing a stack of sheets of stock and an abutment for resting one side of the stack against said abutment; a bent positioned above said counter and receiving a blade for cutting the stock; a holdfast lowerable onto a top side of the stack; a control panel and a display panel positioned on said front side; at least one monitoring camera on said rear side of said counter for monitoring positions of said stock in relation to said stack advancing means and displaying on said display panel a real-time image discernable by said camera for correcting positions of said stock due to imprecise location of all stacked sheets of said stock against said stack advancing means or said abutment at said rear side of said counter; said stack-advancing means is spaced from said abutment by a gap, said at least one camera monitoring said rear side of said counter through said gap, said positions of said stock being corrected so that a sheet at the top of the stack and every sheet in the stack beneath the top sheet is precisely located against said stack advancing means or said abutment at said rear side of said counter.

17. A machine for cutting stacked sheets of stock, comprising: a counter with a rear side for receiving the stock to be cut; said counter having a front side for receiving stock that has been cut; means for advancing a stack of sheets of stock and an abutment for resting one side of the stack against said abutment; a bent positioned above said counter and receiving a blade for cutting the stock; a holdfast lowerable onto a top side of the stack; a control panel and a display panel positioned on said front side; at least one monitoring camera on said rear side of said counter for monitoring positions of said stock in relation to said stack advancing means and displaying on said display panel a real-time image discernable by said camera for correcting positions of said stock due to imprecise location of all stacked sheets of said stock against said stack advancing means or said abutment at said rear side of said counter; said at least one monitoring camera being mounted on said stack-advancing means and traveling along said stack-advancing means, said positions of said stock being corrected so that a sheet at the top of the stack and every sheet in the stack beneath the top sheet is precisely located against said stack advancing means or said abutment at said rear side of said counter.

* * * * *